United States Patent [19]

Montgomery et al.

[11] 3,959,155

[45] May 25, 1976

[54] DETERGENT COMPOSITION

[75] Inventors: Ronald E. Montgomery, Greenhills; William I. Mullane, Jr.; Francis L. Diehl, both of Wyoming; James Byrd Edwards, Cincinnati, all of Ohio

[73] Assignee: The Procter & Gamble Company, Cincinnati, Ohio

[22] Filed: Oct. 1, 1973

[21] Appl. No.: 402,504

[52] U.S. Cl. ..... 252/8.8; 252/120; 252/155; 252/528; 252/545; 252/547

[51] Int. Cl.[2] ..... C11D 10/04; D06M 13/46; D06M 13/52

[58] Field of Search ..... 117/139.5 F, 139.5 CF, 117/139.5 CQ; 252/8.6, 8.8, 155, 547; 260/DIG. 16, DIG. 20

[56] References Cited

UNITED STATES PATENTS

| | | | |
|---|---|---|---|
| 2,746,887 | 5/1956 | O'Neill | 117/139.5 CQ |
| 2,999,774 | 9/1961 | Schappel | 117/139.5 CF |
| 3,274,106 | 9/1966 | Smiens | 252/8.8 |
| 3,515,580 | 6/1970 | Eastes | 252/8.6 |
| 3,537,993 | 11/1970 | Coward et al. | 252/8.8 |
| 3,594,212 | 7/1971 | Ditsch | 117/139.5 CF |
| 3,646,219 | 2/1972 | Peterson | 252/8.6 |
| 3,686,025 | 8/1972 | Morton | 252/8.8 |
| 3,716,488 | 2/1973 | Kolsky et al. | 252/155 |
| 3,850,818 | 11/1974 | Katsumi et al. | 252/8.8 |
| 3,862,058 | 1/1975 | Nirschl et al. | 252/8.6 |
| B305,417 | 1/1975 | Nirschl et al. | 252/8.6 |

*Primary Examiner*—Murray Tillman
*Assistant Examiner*—W. C. Danison, Jr.
*Attorney, Agent, or Firm*—Charles R. Wilson; Jerry J. Yetter; Julius P. Filcik

[57] ABSTRACT

Improved anti-static compositions comprising an electrically conductive metal salt dispersed in a water-insoluble quaternary compound are employed in improved detergent compositions. Detergent-compatible fabric softeners, and detergent compositions containing same, comprising a smectite clay softener and the improved anti-static compositions are provided.

39 Claims, No Drawings

DETERGENT COMPOSITION

BACKGROUND OF THE INVENTION

The present invention relates to improved anti-static agents and to fabric softening compositions containing same. More particularly, the invention encompasses anti-static compositions comprising conductive metal salts dispersed in a substantially water-insoluble quaternary ammonium or quaternary phosphonium compound, and their use in detergent compositions. Combined softening and anti-static compositions containing smectite clay softeners are also provided.

It has long been recognized that quaternary compounds, especially the quaternary ammonium compounds, provide advantageous softening and anti-static effects when applied to fabrics. However, the cationic nature of such quaternary compounds does not allow their use in combination with the common anionic detersive materials such as the alkylbenzene sulfates and sulfonates.

A variety of methods have been employed to provide fabric softening materials which are compatible with anionic detergent compounds. Certain clay minerals have been found to be useful for this purpose, inasmuch as clays have an anionic surface charge and are therefore compatible with anionic detersive surfactants; see the copending application of Storm and Nirschl, Ser. No. 271,943, filed July 14, 1972, now abandoned, and references cited therein.

While the smectite clay fabric softeners are effective for their intended softening use in combination with all manner of detergent compounds, the clays increase the static electrical charge on the fabric surface. A high static charge on a fabric surface, especially on nylon and polyester fabrics under conditions of low humidity, is unacceptable to some users. The use of quaternary anti-static compositions in combination with the clay softeners to alleviate this static charge problem is disclosed in the copending application of Bernardino, Ser. No. 351,678, filed Apr. 16, 1973, now U.S. Pat. No. 3,886,075.

Moreover, common laundry detergents, with or without added smectite clay softeners, do nothing to alleviate the problem of static charges on fabrics, particularly synthetics, when such fabrics are dried in an automatic dryer under conditions of low humidity.

It has now been discovered that improved anti-static agents which are compatible with all manner of organic detergents can be provided by dispersing an electrically conductive metal salt in a substantially water-insoluble quaternary compound of the type described hereinafter. These anti-static compositions are disclosed in the concurrently filled application of Diehl, Ser. No. 402,505, filed Oct. 1, 1973, the disclosures of which are incorporated herein by reference.

Moreover, the foregoing quaternary compound/salt compositions are useful in combination with smectite clays to provide detergent-compatible fabric softening compositions, but without the increased static problems occasioned by the use of clays, singly, as fabric softeners. In another embodiment, laundry detergent compositions having both anti-static and fabric softening benefits are secured by combining the smectite clay softeners and the quaternary compound/salt anti-static agents with detergents, builders, and the like, as disclosed hereinafter.

It is an object of the present invention to provide anti-static detergent compositions.

A second object herein is to provide detergent-compatible fabric softening and anti-static compositions containing smectite clay softeners.

Still another object herein is to provide detergent compositions of concurrently cleansing and softening fabrics without undue buildup of static charges, comprising a detergent component, a smectite clay fabric softening component and an anti-static component comprising an electrically conductive salt dispersed in a substantially water-insoluble quaternary compound.

These and other objects are obtained herein as will be seen from the following disclosures.

SUMMARY OF THE INVENTION

The present invention encompasses fabric softener and anti-static compositions especially adapted for use in combination with anionic, zwitterionic and ampholytic surfactants, comprising:

a. from about 1% to about 99% by weight of a softening component comprising a smectite clay having an ultimate particle diameter of from about 150 angstroms to about 4500 angstroms; and b. from about 1% to about 99% by weight of an anti-static component comprising:

i. a quaternary compound of the formula

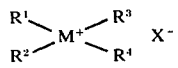

wherein M is nitrogen or phosphorus, X is any anion, $R^1$ is a hydrocarbyl moiety, $R^2$ is hydrogen or a hydrocarbyl moiety, the total carbon content of $R^1 + R^2$ being at least 22 carbon atoms, and $R^3$ and $R^4$ are each hydrogen or hydrocarbyl moieties; and ii. an electrically conductive salt dispersed in said quaternary compound, at a weight ratio of quaternary compound:salt in said anti-static component in the range of 1000:1 to 1:5.

The invention also encompasses detergent compositions adapted to imparting an anti-static effect to fabrics in an aqueous laundering medium, comprising:

a. from about 1% to about 99.9% by weight of a water-soluble detergent component selected from the group consisting of anionic, nonionic, amphoteric and zwitterionic surfactants; and b. from about 0.1% to about 20% by weight of an anti-static component comprising a quaternary compound and a conductive salt of the type disclosed above.

The invention also encompasses detergent compositions adapted to imparting a softening and anti-static effect to fabrics in an aqueous laundering medium, comprising:

a. from about 5% to about 50% by weight of a water-soluble detergent component selected from the group consisting of anionic, nonionic, amphoteric and zwitterionic surfactants;

b. from about 1% to about 40% by weight of a softening component comprising a smectite clay of the type disclosed above; and c. from about 0.1% to about 20% by weight of an anti-static component of the type disclosed above.

Any of the compositions herein can optionally contain the various adjuvant materials commonly employed in laundry products, such as detergency builders, anti-soiling agents, perfumes, and the like.

DETAILED DESCRIPTION OF THE INVENTION

The compositions herein comprise multiple ingredients and components, each of which are described, in turn, below.

Softening Component

The smectite clays useful in the present compositions and processes are fully described in the co-pending application of Storm and Nirschl, Ser. No. 271,943, filed July 14, 1972, now abandoned, the disclosures of which are incorporated herein by reference.

The smectite clays herein can be described as expandable layered clays, i.e., aluminosilicates and magnesium silicates. The term "expandable" as used to describe the instant clays relates to the ability of the layered clay structure to be swollen, or expanded, on contact with water. The expandable clays used herein are those materials classified geologically as smectites (or "montmorillonoids") and are platelets of ca. 50 angstroms thickness.

Smectites are three-layered clays. There are two distinct classes of smectite-type clays. In the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O_5)(OH)_2$, for the aluminum and magnesium oxide type clays, respectively, and both types are useful herein as the softening component. It is to be recognized that the range of the water of hydration in the above formulas can vary with the processing to which the clay has been subjected. This is immaterial in the use of the smectite clays in the present compositions in that the expandable characteristics of the hydrated clays are dictated by the silicate lattice structure. Furthermore, atom substitution by iron and magnesium can occur within the crystal lattice of the smectites, while metal cations such as $Na^+$, $Ca^{++}$, as well as $H^+$, can be copresent in the water of hydration to provide electrical neutrality. Although the presence of iron in such clay material is preferably avoided to minimize discoloration from the preferred all-white form, such cation substitutions in general are immaterial to the use of the clays herein since the desirable fabric softening properties of the clay are not substantially altered thereby.

The layered expandable aluminosilicate smectite clays useful herein are further characterized by a dioctahedral crystal lattice, whereas the expandable magnesium silicate smectite clays have a trioctahedral crystal lattice.

The clay materials useful in the present invention are described more fully in H. van Olphen, "Clay Minerology", *An Introduction to Clay Colloid Chemistry*, Interscience Publishers, 1963; pp 54–73 and Ross and Hendricks, "Minerals of the Montmorillonite Group" *Professional Paper 205B of the United States Department of the Interior Geological Survey*, 1945; pp 23–79; both articles being incorporated herein by reference.

More specifically, the smectite clays used in the compositions herein are all commercially available. Such clays include, for example, montmorillonite (bentonite), volchonskoite, nontronite, beidellite, hectorite, saponite, sauconite and vermiculite. The clays herein are available under commercial names such as "Fooler Clay" (clay found in a relatively thin vein above the main bentonite or montmorillonite veins in the Black Hills) and various trade names such as Brock, Thixogel No. 1 and Gelwhite GP from Georgia Kaolin Company, Elizabeth, New Jersey; Volclay BC and Volclay No. 325, from American Colloid Company, Skokie, Illinois; Black Hills Bentonite BH 450, from International Minerals and Chemicals; Veegum Pro and Veegum F, from R. T. Vanderbilt (both hectorites); Barasym NAS-100, Barasym NAH-100 and Barasym LIH-200, all synthetic hectorites and saponites marketed by Baroid Division, NL Industries, Inc.

Preferred clay softeners herein include montmorillonite, volschonskoite, nontronite, beidellite, hectorite, saponite, sauconite and vermiculite.

Montmorillonite, hectorite and saponite are highly preferred smectites herein. Brock, Gelwhite GP, Barasym NAS-100 and Barasym NAH-100 are the preferred montmorillonites, hectorites and saponites, inasmuch as these commercial products are nearly pure white.

The smectite clays herein have an ultimate particle diameter of from about 150 angstroms to about 4500 angstroms, preferably about 200 angstroms to about 500 angstroms. By "ultimate particle diameter" herein is meant the largest dimension of the individual clay platelets when dispersed in water. Particle thickness is an integral multiple unit of the unit cell thickness of 15 angstroms. Smectite clays of this type spontaneously form a colloidal dispersion on admixture with water.

Brook clay, a Wyoming bentonite having an ultimate particle diameter of from about 200 angstroms to about 500 angstroms, is especially preferred as the softener component herein.

Anti-Static Component

The anti-static component of the present compositions is more fully described in the concurrently filed application of Diehl, Ser. No. 402,505, filed Oct. 1, 1973, the disclosures of which are incorporated hereby by reference. The anti-static component comprises a quaternary compound and a conductive salt, and is prepared in the manner disclosed hereinafter.

i. Quaternary Compound

The quaternary compounds employed herein are of the formula $R^1R^2R^3R^4M^+X^-$, as set forth above, and are the substantially water-insoluble ammonium and phosphonium materials well-known in the art. Both the ammonium and phosphonium compounds herein can be prepared from alkyl halides and amines or phosphines in the manner described in U.S. Pat. No. 2,775,617. The ammonium compounds are preferred for use herein by virtue of their availability and relatively low cost.

More particularly, the ammonium and phosphonium compounds employed in the present compositions are substantially water-insoluble materials. By "substantially water-insoluble" is meant that the compounds employed herein are not substantially dissolved in water at a temperature below about 130°F. The water-insolubility of the quaternary compounds herein is the result of the hydrophobic characteristics of the hydrocarbyl substituents in the compounds. For purposes of the present invention, the requisite water-insolubility is realized when the total carbon content of groups $R^1$ and $R^2$ is at least 22 carbon atoms. For most purposes, di-long chain compounds wherein groups $R^1$ and $R^2$ are each $C_{11}$-$C_{18}$ hydrocarbyl moieties, and mixtures thereof, are preferred for use herein. However, compounds wherein group $R^1$ is $C_{22}$, and greater, and wherein group $R^2$ is a short-chain hydrocarbyl moiety, are sufficiently water-insoluble to be useful herein. $R^3$ and $R^4$ can be $C_1$-$C_{18}$ hydrocarbyl moieties.

Preferred quaternary compounds herein have groups $R^1$, $R^2$, $R^3$ and $R^4$ as hydrocarbyl moieties. The term hydrocarbyl moiety as employed herein encompasses alkyl, alkenyl, aryl, alkaryl, substituted alkyl and alkenyl, and substituted aryl and alkaryl groups. Common substituents found on quaternary compounds include hydroxy and alkoxy groups, and substituted compounds of this type are well-recognized in the art as useful fabric softening materials.

The most preferred quaternary compounds herein are those wherein the substituent groups $R^1$, $R^2$, $R^3$ and $R^4$ are alkyl groups. Especially preferred materials herein are the di-long chain compounds wherein $R^1$ and $R^2$ are each selected from the group consisting of $C_{11}$-$C_{18}$ alkyl moieties, and mixtures thereof, and wherein $R^3$ and $R^4$ are each selected from the group consisting of short-chain $C_1$-$C_3$ alkyl moieties, and mixtures thereof.

While it is possible to prepare the quaternary compounds employed herein using pure alkyl amines or alkyl phosphines or pure alkyl halides, raw materials with mixed hydrocarbyl moieties are commonly employed, for economic reasons. The use of such mixtures results in the formation of mixtures of the quaternary compounds, and all such mixtures are contemplated for use herein. A particularly advantageous quaternary mixture herein is a derivative of tallow chain length hydrocarbons, di-tallowalkyl dimethyl ammonium chloride.

In the quaternary compounds herein, the anion, X, provides electrical neutrality. The nature of anion, X, is of no consequence to the present invention and any anion is useful herein. Most often, the anion used to provide electrical neutrality in quaternary compounds is a halide, such as fluoride, chloride, bromide, or iodide. However, particularly useful anions in quaternary compounds also encompass methylsulfate, ethylsulfate, hydroxide, acetate, sulfate, carbonate, and the like. Chloride is especially preferred herein as anion, X, inasmuch as the alkyl chlorides are economically attractive precursors for preparing quaternary compounds.

The following are non-limiting examples of the water-insoluble, water-dispersible quaternary compounds which can be employed herein: docosyl ammonium chloride; docosyl ethyl ammonium bromide; docosyl dimethyl phosphonium fluoride; docosyl tributyl phosphonium hydroxide; di-octadecyl dimethyl phosphonium hydroxide; tetrakis-dodecyl ammonium methylsulfate; tallowalkyl dimethyl pentyl ammonium chloride; di-tallowalkyl dimethyl ammonium chloride; di-tallowalkyl dimethyl ammonium methyl sulfate; di-hexadecyl dimethyl ammonium chloride; di-octadecyl dimethyl ammonium chloride; di-eicosyl dimethyl ammonium chloride; di-docosyl dimethyl ammonium chloride; di-hexadecyl diethyl ammonium chloride; di-hexadecyl dimethyl ammonium acetate; di-tallowalkyl dipropyl ammonium phosphate, di-tallowalkyl dimethyl ammonium nitrate; and di-(coconutalkyl) dimethyl ammonium chloride.

ii. Conductive Salt

The conductive salts employed in combination with the quaternary compounds herein can be any salt which can dissociate into its component cation and anion, thereby providing a means for conducting electrical charges. Preferred salts herein are those having a cation-anion bond of at least 50% ionic character, as calculated in the manner described in Pauling, "The Nature of the Chemical Bond", 3rd Ed. (1960). The most preferred salts herein are whose wherein the cation has a small radius and/or multiple charges. A small ionic radius provides rapid ionic mobility, thereby promoting dissipation of static charges at a rapid rate. Highly charged cations are most efficient in dissipating electrical charges than are monovalent cations. While any metal salt is useful herein, it is preferred to select salts of cations which are relatively non-toxic and are not highly colored, so as to prevent undesirable side-effects when the salts are absorbed on a fabric surface.

The salts useful herein are prepared by neutralizing the base form of the selected metal cation with an acid. Of course, the anion of the acid then becomes the anion of the resulting salt. Essentially any acid can be used to prepare the conductive metal salts used in the present compositions. Inorganic acids, such as HCl, HBr, HI, $H_2SO_4$, $HNO_3$, $H_3PO_4$, and the like, can be employed. Organic acids such as acetic acid, propionic acid, butyric acid, and the $C_{10}$-$C_{18}$ fatty acids are all useful herein. The inorganic acid salts are preferred herein from the standpoint of cost and availability. Moreover, the inorganic salts are more readily dispersed in the quaternary ammonium compounds herein.

Representative examples of conductive metal salts useful herein are as follows: LiCl; NaCl, CsBr; $MgCl_2$; $CaCl_2$; $Zn(NO_3)_2$; $Al_2(SO_4)_3$; $InCl_3$; $Ti(SO_4)_4$; and the like. Organic salts useful herein include, for example, sodium acetate, magnesium propionate, aluminum acetate, aluminum laurate; aluminum dodecyl benzene sulfonate; and the like.

Especially preferred salts herein are hydrated, inasmuch as the waters of hydration aid in the dissipation of static electrical charges. Examples of hydrated salts useful herein include $CaCl_2 \cdot 6\ H_2O$; $LiCl \cdot 1\ H_2O$; $MgCl_2 \cdot 6\ H_2O$; and $Al_2(SO_4)_3 \cdot 18\ H_2O$.

The salts of aluminum and lithium are especially preferred herein, with the aluminum salts being most preferred. Lithium provides a small, highly mobile cation which is particularly effective in dissipating static electrical charges when employed in the present manner. Aluminum provides a highly charged, highly mobile cation which is especially effective in dissipating static electrical charges both by virtue of its ionic mobility and its poly-cationic character. However, aluminum salts are inexpensive and non-staining to fabrics.

Preferred metal salts useful herein include $Al_2(SO_4)_3$; $Al_2(SO_4)_3 \cdot 18\ H_2O$; $LiCl \cdot 1\ H_2O$: $MgCl_2 \cdot 6\ H_2O$; $CaCl_2 \cdot 6\ H_2O$; NaCl; and KCl. $Al_2(SO_4)_3$, $LiCl \cdot 1\ H_2O$ and $Al_2(SO_4)_3 \cdot 18\ H_2O$ are especially preferred for use in the present compositions and processes, with $Al_2(SO_4)_3 \cdot 18\ H_2O$ being most preferred.

iii. Anti-Static Component Processing

The anti-static component herein comprises the conductive salt dispersed in and with the quaternary compound. It is desirable that the dispersion of the salt be uniform throughout the matrix comprising the quaternary compound. Moreover, it is desirable to provide the anti-stat in the form of finely divided particles. For these reasons, high shear mixing is preferably used to prepare the instant salt/quaternary compositions. Powdered carriers are also used to advantage to maintain the salt/quaternary materials in a crisp, free-flowing state.

Two procedures can be employed to prepare the anti-static component. In the first, the conductive salt is reduced to a fine state of aggregation by grinding, or the like, to provide a powder. The average particle size distribution of the powdered conductive salts is not critical for the present purposes, but will commonly be within the range of from about 0.01 microns to about 100 microns. The quaternary compound is melted and the powdered conductive salt added thereto and the mixture blended to provide intimate contact between the quaternary compound and conductive salt. The composition is then further blended in a colloid mill or ribbon blender, thereby establishing the salt as a uniform dispersion within the matrix comprising the quaternary compound.

In a second procedure, the metal salt is dissolved in water, conveniently at a concentration of from about 25% to about 50% by weight, and the aqueous solution is thoroughly admixed with a melt of the quaternary compound. The aqueous salt solution and quaternary compound are blended, preferably with high shear mixing, and the conductive salt preferentially migrates into the mesomorphic phase comprising the quaternary compound. Once the conductive salt is established in the quaternary compound matrix, the excess water is removed by filtration or evaporation.

In the preparation of the anti-static component used herein, it is preferred to employ the quaternary compound in the form of a melt. Most of the water-insoluble quaternary compounds have melting points above about 120°F. Accordingly, it is convenient to employ the quaternary compound in combination with a modicum of water and alcohol, preferably isopropyl alcohol, which lowers the melting point of the quaternary material to a range of from about 70°F to about 90°F. In such fashion, the quaternary compound is rendered pasty and the dispersion of the salt therein can be conveniently achieved at plant operating temperatures. For most purposes, from about 5% to about 10% by weight of water and/or water-alcohol mixtures will provide the quaternary compound in this convenient pasty form. The water and alcohol can be removed from the final composition by evaporation, or can be simply left in the composition, depending on the desires of the user.

Preferred anti-static components prepared in the foregoing manner comprise the conductive salt dispersed in the quaternary compound at a weight ratio of quaternary compound:conductive salt in the range from about 20:1 to about 1:2. A highly preferred anti-static component comprises from about 5% to about 50% by weight of $Al_2(SO_4)_3 \cdot 18\ H_2O$ and from about 50% to about 95% by weight of ditallowalkyl dimethyl ammonium chloride.

When preparing dry, free-flowing detergent granules, it is preferred to use the salt/quaternary compound anti-stat sorbed on a carrier matrix. Various carriers are useful for this purpose and the choice of carriers is not critical herein. Preferably, the carriers are non-hygroscopic. Any of the detergency builder materials disclosed hereinafter can be used as a carrier. Water-insoluble silica, especially the silica marketed as Zeosyl, is useful for this carrier purpose.

When a carrier is employed, it is convenient to coat the carrier with the dispersion of conductive salt and quaternary compound prepared in the foregoing manner by a simple spray-on procedure. The melt of salt-/quaternary anti-stat, preferably in combination with a small amount of water and isopropanol, as described above, is sprayed onto, or otherwise blended with, the carrier granules at a weight ratio of carrier:anti-stat of from about 1:6 to about 6:1. Excess water and alcohol can be removed by evaporation to provide crisp, free-flowing granules suitable for use in a dry, non-tacky detergent composition.

Detergent Component

The detergent compositions of the instant invention can contain all manner of anionic, nonionic, semi-polar, zwitterionic and amphoteric organic, water-soluble detersive surfactant (detergent) compounds, inasmuch as the other components are compatible with all such materials at the concentrations and proportions disclosed herein. A typical listing of the classes and species of detergent compounds useful herein appears in U.S. Pat. No. 3,664,961, incorporated herein by reference. The following list of detergent compounds and mixtures which can be used in the instant compositions and processes is representative of such materials, but it is not intended to be limiting.

Water-soluble salts of the higher fatty acids, i.e., "soaps" are useful as the detergent component herein. This class of detergents includes ordinary alkali metal soaps such as the sodium, potassium, ammonium and alkylolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Another class of detergents include water-soluble salts, particularly the alkali metal, ammonium and alkylolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic detergents which can be used in the present invention are the sodium and potassium alkyl sulfates, especially those obtained by sulfating the higher alcohols ($C_8$ - $C_{18}$ carbon atoms) produced by reducing the glycerides of tallow or coconut oil; and sodium and potassium alkyl benzene sulfonates, in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkyl benzene sulfonates in which the average of the alkyl groups is about 13 carbon atoms, abbreviated as $C_{13}$ LAS.

Other anionic detergent compounds herein include the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Nonionic semi-polar detergents useful herein include water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxide detergents containing one alkyl moiety of about 10 to 28 carbon atoms and 2 moieties selected from the group consisting of alkyl groups and hydroxyalkyl groups containing from about 1 to 3 carbon atoms; and water-soluble sulfoxide detergents containing one alkyl moiety of from about 10 to 28 carbon atoms and a moiety selected from the group consisting of alkyl and hydroxyalkyl moieties of from 1 to 3 carbon atoms.

Ampholytic detergents include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic detergents include derivatives of aliphatic quaternary ammonium, phosphonium and sulfonium compounds in which the aliphatic moieties can be straight chain or branched, and wherein one of the aliphatic substituents contains from about 8 to 18 carbon atoms and one contains an anionic water solubilizing group.

Other useful detergent compounds herein include the water-soluble salts of esters of $\alpha$-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Preferred water-soluble organic detergent compounds herein include linear alkyl benzene sulfonates containing from about 11 to 14 carbon atoms in the alkyl group; the tallow range alkyl sulfates; the coconut range alkyl glycercyl sulfonates; alkyl ether sulfates wherein the alkyl moiety contains from about 14 to 18 carbon atoms and wherein the average degree of ethoxylation varies between 1 and 6; the sulfated condensation products of tallow alcohol with from about 3 to 10 moles of ethylene oxide; olefin sulfonates containing from about 14 to 16 carbon atoms; alkyl dimethyl amine oxides wherein the alkyl group contains from about 11 to 16 carbon atoms; alkyldimethylammonio-propane-sulfonates and alkyl-dimethylammonio-hydroxy-propane-sulfonates wherein the alkyl group in both types contains from about 14 to 18 carbon atoms; and soaps, as hereinabove defined.

Specific preferred detergents for use herein include: sodium linear $C_{10}$ - $C_{18}$ alkyl benzene sulfonate; triethanolamine $C_{10}$ - $C_{18}$ alkyl benzene sulfonate; sodium tallow alkyl sulfate, sodium coconut alkyl glyceryl ether sulfonate; the sodium salt of a sulfated condensation product of a tallow alcohol with from about 3 to about 10 moles of ethylene oxide; 3-(N,N-dimethyl-N-coconutalkylammonio)-2-hydroxypropane-1-sulfonate; 3-(N,N-dimethyl-N-coconutalkylammonio)-propane-1-sulfonate; 6-(N-dodecylbenzyl-N,N-dimethylammonio)hexanoate; dodecyl dimethyl amine oxide; coconut alkyl dimethyl amine oxide; and the water-soluble sodium and potassium salts of higher fatty acids containing 8 to 24 carbon atoms.

It is to be recognized that any of the foregoing detergents can be used separetely herein or as mixtures. Examples of preferred detergent mixtures herein are as follows.

An especially preferred alkyl ether sulfate detergent component useful in the instant compositions and processes is a mixture of alkyl ether sulfates, said mixture having an average (arithmetic mean) carbon chain length within the range of from about 12 to 16 carbon atoms, preferably from about 14 to 15 carbon atoms, and an average (arithmetic mean) degree of ethoxylation of from about 1 to 4 moles of ethylene oxide, preferably from about 2 to 3 moles of ethylene oxide; see copending application of Jacobsen and Krummel, Ser. No. 306,330, filed Nov. 13, 1972, incorporated herein by reference.

Specifically, such preferred mixtures comprise from about 0.05% to 5% by weight of mixture of $C_{12-13}$ compounds, from about 55% to 70% by weight of mixture of $C_{14-15}$ compounds, from about 25% to 40% by weight of mixture of $C_{16-17}$ compounds and from about 0.1% to 5% by weight of mixture of $C_{18-19}$ compounds. Further, such preferred alkyl ether sulfate mixtures comprise from about 15% to 25% by weight of mixture of compounds having a degree of ethoxylation of 0, from about 50% to 65% by weight of mixture of compounds having a degree of ethoxylation from 1 to 4, from about 12% to 22% by weight of mixture of compounds having a degree of ethoxylation from 5 to 8 and from about 0.5% to 10% by weight of mixture of compounds having a degree of ethoxylation greater than 8.

Examples of alkyl ether sulfate mixtures falling within the above-specified ranges are set forth in Table I.

TABLE I

| MIXTURE CHARACTERISTIC | ALKYL ETHER SULFATE MIXTURE | | | |
|---|---|---|---|---|
| Average carbon chain Length (No. C Atoms) | I 14.86 | II 14.68 | III 14.86 | IV 14.88 |
| 12–13 carbon atoms (wt.%) | 4% | 1% | 1% | 3% |
| 14–15 carbon atoms (wt.%) | 55% | 65% | 65% | 57% |
| 16–17 carbon atoms (wt.%) | 36% | 33% | 33% | 38% |
| 18–19 carbon atoms (wt.%) | 5% | 1% | 1% | 2% |

TABLE I—continued

| MIXTURE CHARACTERISTIC | ALKYL ETHER SULFATE MIXTURE | | | |
|---|---|---|---|---|
| Average carbon chain Length (No. C Atoms) | I 14.86 | II 14.68 | III 14.86 | IV 14.88 |
| Average degree of ethoxylation (No. Moles EO) | 1.98 | 2.25 | 2.25 | 3.0 |
| 0 moles ethylene oxide (wt.%) | 15% | 21% | 22.9% | 18% |
| 1–4 moles ethylene oxide (wt.%) | 63% | 59% | 65% | 55% |
| 5–8 moles ethylene oxide (wt.%) | 21% | 17% | 12% | 22% |
| 9+ moles ethylene oxide (wt.%) | 1% | 3% | 0.1% | 5% |
| Salt | K | Na | Na | Na |

Preferred "olefin sulfonate" detergent mixtures utilizable herein comprise olefin sulfonates containing from about 10 to about 24 carbon atoms. Such materials can be produced by sulfonation of α-olefins by means of uncomplexed sulfur dioxide followed by neutralization under conditions such that any sultones present are hydrolyzed to the corresponding hydroxyalkane sulfonates. The α-olefin starting materials preferably have from 14 to 16 carbon atoms. Said preferred α-olefin sulfonates are described in U.S. Pat. 3,332,880, incorporated herein by reference.

Preferred α-olefin sulfonate mixtures herein consist essentially of from about 30% to about 70% by weight of a Component A, from about 20% to about 70% by weight of a Component B, and from about 2% to about 15% of a Component C, wherein a. said Component A is a mixture of double-bond positional isomers of water-soluble salts of alkene-1-sulfonic acids containing from about 10 to about 24 carbon atoms, said mixture of positional isomers including about 10% to about 25% of an alpha-beta unsaturated isomer, about 30% to about 70% of a beta-gamma unsaturated isomer, about 5% to about 25% of gamma-delta unsaturated isomer, and about 5% to about 10% of a delta-epsilon unsaturated isomer;

b. said Component B is a mixture of water-soluble salts of bifunctionally-substituted sulfur-containing saturated aliphatic compounds containing from about 10 to about 24 carbon atoms, the functional units being hydroxy and sulfonate groups with the sulfonate groups always being on the terminal carbon and the hydroxyl group being attached to a carbon atom at least two carbon atoms removed from the terminal carbon atoms aat least 90% of the hydroxy group substitutions being in 3, 4, and 5 positions; and c. said Component C is a mixture comprising from about 30%–95% water-soluble salts of alkene disulfonates containing from about 10 to about 24 carbon atoms, and from about 5% to about 70% water-soluble salts of hydroxy disulfonates containing from about 10 to about 24 carbon atoms, said alkene disulfonates containing a sulfonate group attached to a terminal carbon atom and a second sulfonate group attached to an internal carbon atom not more than about six carbon atoms removed from said terminal carbon atom, the alkene double bond being distributed between the terminal carbon atom and about the seventh carbon atom, said hydroxy disulfonates being saturated aliphatic compounds having a sulfonate group attached to a terminal carbon, a second sulfonate group attached to an internal carbom atom not more than about six carbon atoms removed from said terminal carbon atom, and a hydroxy group attached to a carbon atom which is not more than about four carbon atoms removed from the site of attachment of said second sulfonate group.

Nonionic detergent compounds, such as the well-known ethylene oxide condensates of alcohols and phenols are also useful herein. A representative listing of such materials is found in U.S. Pat. No. 3,664,961, cited above. The hexa- through deca-ethoxylates of mixed coconutalkyl alcohols are particularly useful herein.

Mixtures of the foregoing surfactants are also useful as the detergent component herein.

Adjunct Materials

The compositions herein can contain, in addition to the organic detergent compounds, all manner of detergency builders commonly taught for use in detergent compositions. Such builders can comprise from about 5% to about 80% by weight, preferably from about 15% to about 45% by weight, of the compositions. Useful builders herein include any of the conventional inorganic and organic water-soluble builder salts.

Such detergency builders can be, for example, water-soluble salts of phosphates, pyrophosphates, orthophosphates, polyphosphates, phosphonates, carbonates, polyhydroxysulfonates, silicates, polyacetates, carboxylates, polycarboxylates and succinates. Specific examples of inorganic phosphate builders include sodium and potassium tripolyphosphates, phosphates, and hexametaphosphates. The polyphosphonates specifically include, for example, the sodium and potassium salts of ethylene diphosphonic acid, the sodium and potassium salts of ethane 1-hydroxy-1, 1-diphosphonic acid and the sodium and potassium salts of ethane-1,1,2-triphosphonic acid. Examples of these and other phosphorous builder compounds are disclosed in U.S. Pat. Nos. 3,159,581; 3,213,030; 3,422,021; 3,422,137; 3,400,176 and 3,400,148, incorporated herein by reference.

Non-phosphorus containing sequestrants can also be selected for use herein as detergency builder.

Specific examples of non-phosphorus, inorganic builder ingredients include water-soluble inorganic carbonate, bicarbonate, and silicate salts. The alkali metal, e.g., sodium and potassium, carbonates, bicarbonates, and silicates are particularly useful herein.

Water-soluble, organic builders are also useful herein. For example, the alkali metal, ammonium and substituted ammonium polyacetates, carboxylates, polycarboxylates and polyhydroxysulfonates are useful builders in the present compositions and processes. Specific examples of the polyacetate and polycarboxylate builder salts include sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Highly preferred non-phosphorous builder materials herein include sodium carbonate, sodium bicarbonate, sodium silicate, sodium citrate, sodium oxydisuccinate, sodium mellitate, sodium nitrilotriacetate, and sodium ethylenediaminetetraacetate, and mixtures thereof.

Other highly preferred builders herein are the polycarboxylate builders set forth in U.S. Pat. No. 3,308,067, Diehl, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid and methylenemalonic acid.

Additional, preferred builders herein include the water-soluble salts, especially the sodium and potassium salts, of carboxymethyloxymalonate, carboxymethyloxysuccinate, cis-cyclohexanehexcarboxylate, cis-cyclopentanetetracarboxylate and phloroglucinol trisulfonate.

Another type of detergency builder material useful in the present compositions and processes comprises a water-soluble material capable of forming a water-insoluble reaction product with water hardness cations in combination with a crystallization seed which is capable of providing growth sites for said reaction product. Such "seeded builder" compositions are fully disclosed in the co-pending application of Benjamin, Ser. No. 248,546, filed Apr. 28, 1972, the disclosures of which are incorporated herein by reference.

More particularly, the seeded builders useful herein comprises a crystallization seed having a maximum particle dimension of less than 20 microns preferably a particle diameter of from about 0.01 micron to about 1 micron, in combination with a material capable of forming a water-insoluble reaction product with free metals ions.

Many builder materials, e.g., the water-soluble carbonate salts, precipitate water hardness cations, thereby performing a builder function. Unfortunately, many of the precipitating builders used in detergent compositions do not reduce the free metal ion content of laundry baths quickly, and such builders only compete with the organic detergent and the soil for the free metal ions. The result is that while some of the free metal ions are removed from the solution, some ions do react with the organic detergent and the soil, thereby decreasing the detersive action. The use of the crystallization seed quickens the rate of precipitation of the metal hardness, thereby removing the hardness ions before they can adversely affect the detergency performance.

By using a material capable of forming a water-soluble product with free metal ions in combination with a crystallization seed, the combined free metal ion concentration of an aqueous laundering liquor can be reduced to less than 0.5 grains of hardness within about 120 seconds. In fact, the preferred seeded builders can reduce the free metal hardness to less than 0.1 grains/gallon within about 30 seconds.

Preferred seeded builders consist of: a water-soluble material capable of forming a reaction product having a solubility in water of less than about $1.4 \times 10^{-2}$ wt.% (at 25°C) with divalent and polyvalent metal ions such as calcium, magnesium and iron; and a crystallization seed (0.001–20 micron diameter) which comprises a material which will not completely dissolve in water within 120 seconds at 25°C.

Specific examples of materials capable of forming the water-insoluble reaction product include the water-soluble salts of carbonates, bicarbonates, sesquicarbonates, silicates, aluminates and oxalates. The alkali metal, especially sodium, salts of the foregoing materials are preferred for convenience and economy.

The crystallization seed employed in such seeded builders is preferably selected from the group consisting of calcium carbonate; calcium and magnesium oxalates; barium sulfate; calcium, magnesium and aluminum silicates; calcium and magnesium oxides; calcium and magnesium salts of fatty acids having 12 to 22 carbon atoms; calcium and magnesium hydroxides; calcium fluoride; and barium carbonate. Specific examples of such seeded builder mixtures comprise: 3:1 wt. mixtures of sodium carbonate and calcium carbonate having a 5 micron particle diameter; 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 micron; and a 3:3:1 wt. mixture of sodium carbonate, sodium aluminate and calcium oxide having a particle diameter of 5 microns.

The detergent compositions can contain all manner of additional materials commonly found in laundering and cleaning compositions, e.g., thickeners and soil suspending agents such as carboxymethylcellulose and the like. Enzymes, especially the thermally stable proteolytic and lipolytic enzymes commonly used in laundry detergent compositions, can also be present herein. Various perfumes, optical bleaches, fillers, anti-caking agents, fabric softeners and the like can be present to provide the usual benefits occasioned by the use of such materials in detergent compositions. Perborate bleaches commonly employed in European detergent compositions can also be present as a component of the compositions herein. It is to be recognized that all such adjuvant materials are useful, inasmuch as they are compatible and stable in the presence of the softening, anti-static and detergent components used herein.

Composition Processing

The combined fabric softener and anti-static compositions herein are prepared by simply dry blending the smectite clay softening component and anti-static component. Preferred compositions herein are those wherein the weight ratio of softening component:anti-static component is in the range of from about 1:2 to about 25:1.

Highly preferred softening and anti-static compositions herein are those wherein the ratio fo quaternary compound:conductive salt is in the range of from about 20:1 to about 1:2.

A highly preferred fabric softening and anti-static composition herein has, as the anti-static component, a mixture comprising:

i. from about 40% to about 50% by weight of $Al_2(SO_4)_3 \cdot 18\ H_2O$; and ii. from about 50% to about 60% by weight of di-tallowalkyl dimethyl ammonium chloride.

The detergent compositions prepared in the manner of the present invention can be in liquid or granular form, with the granular form being most preferred. The preparation of detergent compositions containing the anti-static components herein is achieved by simply dry-blending the dispersion of conductive salt and quaternary compound with the remaining ingredients of the composition. In order to provide a crisp, free-flowing granule, it is preferred to sorb the salt/quaternary anti-static agent on a carrier, preferably a silica carrier, as disclosed hereinabove. The portion of the detergent compositions, exclusive of the anti-static component, can be dry-mixed or spray-dried to homogeneous granules in standard fashion. The anti-static component is preferably dry-mixed with the remaining detergent composition ingredients, and is preferably not crutched or spray-dried, inasmuch as this can cause hydrolysis and decomposition of the quaternary compound.

In the preparation of the combined fabric softening, anti-static and detergent compositions herein, the smectite clay softening component can be spray-dried with the remaining components of the composition, exclusive of the anti-static component, to form homogeneous granules, and the anti-static agent dry-mixed therewith. Alternatively, the clay and anti-static component can be dry-mixed with the remaining detergent composition ingredients.

Preferred detergent compositions herein especially adapted to imparting a softening and anti-static effect to fabrics in an aqueous laundering medium contain the smectite clay softening component and salt/quaternary danti-static component in a weight ratio of from about 1:2 to about 10:1.

Highly preferred softening and anti-static detergent compositions herein contain di-tallowalkyl dimethyl ammonium chloride as the quaternary compound. Aluminum salts are preferred as the conductive salts in the anti-static component.

Highly preferred detergent compositions herein have, as the anti-static component, the quaternary compound and conductive salt at a weight ratio in the range of from about 20:1 to about 1:2, and are formulated at a ratio of smectite clay softening component-:anti-static component in the range of about 1:1 to about 10:1.

For heavy duty use, the detergent compositions herein can contain, as an additional component, from about 5% to about 80% by weight of a detergency builder.

The most highly preferred detergent compositions herein comprise:

a. from about 4% to about 10% by weight of an alkyl ether sulfate detergent component;
b. from about 5% to about 20% by weight of a Wyoming bentonite clay softening component having a particle diameter of from about 0.01 microns to about 550 microns;
c. from about 5% to about 15% by weight of an anti-static component comprising:
   i. from about 20% to about 50% by weight of $Al_2(SO_4)_3 \cdot 18\ H_2O$; and
   ii. from about 50% to about 80% by weight of di-tallowlakyl dimethyl ammonium chloride; and
d. from about 15% to about 40% by weight of a detergency builder.

Mixtures of sodium carbonate and sodium silicate are preferred builders herein. Especially preferred are builder mixtures comprising $Na_2CO_3$ and $Na_2SiO_3$ ($SiO_2$:$Na_2O$ wt. ratio = 2.4) at a weight ratio of from about 1:2 to about 2:1.

Highly preferred detergent compositions herein additionally contain up to about 15% by weight of sodium linear alkyl (alkyl = $C_{12}$ avg.) sulfonate.

The following are non-limiting examples of the compositions herein.

EXAMPLE I

A fabric softener and anti-static composition useful in combination with anionic, zwitterionic and ampholytic surfactants is as follows.

| Ingredient | Wt.% |
|---|---|
| Clay* | 60 |
| Di-tallowalkyl dimethyl ammonium chloride | 20 |
| $Al_2(SO_4)_3 \cdot 18\ H_2O$ | 10 |
| Silica** | Balance |

*Wyoming Bentonite, avg. particle diameter 500 microns.
**Microfine silica marketed as Zeosyl.

The foregoing composition is prepared by melting the di-tallowalkyl dimethyl ammonium chloride and admixing the hydrated aluminum sulfate therewith. The resulting anti-static component, as a pasty melt, is passed twice through a colloid mill to provide a uniform dispersion. Next, the silica is admixed with the anti-static component and the mixture again passed through a colloid mill. The resulting product is dry, crisp and free-flowing. The clay is admixed with the anti-static material and blended to give a uniform dispersion.

The foregoing composition is added to an aqueous laundry bath at a concentration of 0.03% by weight. An unbuilt detergent composition containing 15% by weight of linear alkylbenzene sulfonate is added to the aqueous laundering bath at a concentration of 0.08% by weight. Fabrics laundered in the bath are provided with a soft, anti-static finish.

In the foregoing composition the Wyoming bentonite is replaced by an equivalent amount of volschonskoite, nontronite, beidellite, hectorite, saponite, sauconite and vermiculite, respectively, and equivalent results are secured.

In the foregoing composition the hydrated aluminum sulfate is replaced by an equivalent amount of $Al_2(SO_4)_3$, $LiCl.1H_2O$, $MgCl_2.6\ H_2O$, $CaCl_2.6\ H_2O$, KCl, and NaCl, respectively, and fabrics laundered in the compositions are softened and provided with an anti-static finish.

EXAMPLE II

A detergent composition adapted to imparting an anti-static effect to fabrics in an aqueous laundering medium is as follows.

| Ingredient | Wt.% |
|---|---|
| $C_{12}$ (avg.) alkylbenzene sulfonate, sodium salt | 6 |
| Coconutalkyl ethoxylate (6) | 4 |
| Sodium tripolyphosphate | 40 |
| Di-tallowalkyl dimethyl ammonium chloride | 5 |
| $Al_2(SO_4)_3 \cdot 18\ H_2O$ | 5 |
| Silica* | 15 |
| Carboxymethyl cellulose, sodium | 5 |

-continued

| Ingredient | Wt.% |
|---|---|
| Cornstarch | 5 |
| Water | Balance |

*Microfine silica marketed as Zeosyl.

The foregoing composition is prepared by blending the hydrated aluminum sulfate and a melt comprising the di-tallowalkyl dimethyl ammonium chloride through a colloid mill. The cornstarch and silica are then admixed with the colloidal dispersion of aluminum sulfate and the quaternary compound, and the mixture is again passed through the colloid mill. The resulting anti-static composition is in the form of crisp, free-flowing particles. The remaining components of the composition are admixed in a crutcher and spray-dried to form free-flowing detergent granules. The detergent granules are dry-mixed with the anti-static particles to provide the final composition.

The foregoing composition is added to an aqueous laundering bath at a temperature of 120°F at a concentration of 0.3% by weight and a mixed load of nylon, polyester, and cotton fabrics are laundered therein. Following the laundering operation the clothes are removed and placed in a hot air dryer. The clothes are dried at a temperature of ca. 150°F for 50 minutes. When removed from the dryer, the clothes are clean and are substantially free from residual static electrical charges.

EXAMPLE III

The following is a detergent composition which is adapted to imparting a softening and anti-static effect to fabrics in an aqueous laundering medium.

| Ingredient | Total Wt.% |
|---|---|
| Detergent Component | |
| Sodium carbonate | 15 |
| Sodium silicate ($SiO_2$:$Na_2O$ = 2.4) | 20 |
| $C_{12}$ linear alkylbenzene sulfonate, sodium | 12.5 |
| Alkylether sulfate, Sodium* | 6 |
| Sodium sulfosuccinate | 2 |
| Softening Component | |
| Wyoming bentonite | 13 |
| Water, dextran glue, ultramarine blue colorant | 4.7 (total) |
| Anti-Static Component | |
| Di-tallowalkyl dimethyl ammonium chloride | 6 |
| $Al_2(SO_4)_3 \cdot 18\ H_2O$ | 6 |
| Silica** | 2 |
| Balance | |
| Water, perfume, optical brightener, miscellaneous minors | |

*Mixture corresponding to Table I, column I, above.
**Microfine $SiO_2$.

The detergent component of the foregoing composition is prepared by admixing the ingredients in the relative ratios indicated and spray-drying to provide crisp, free-flowing granules.

The clay component, which comprises Wyoming bentonite with a dry particle diameter averaging about 500 microns, is agglomerated with a water solution of dextran glue and ultramarine blue colorant. Colored agglomerates of the clay are thereby provided which are in the form of attractive, blue, water-dispersible speckles. The water-soluble dextran glue insures that the clay speckles will rapidly dissociate in an aqueous laundering medium to the individual clay platelets having an ultimate diameter of ca. 200–500 angstroms.

The anti-static component is prepared by admixing the hydrated aluminum sulfate, di-tallowalkyl dimethyl ammonium chloride melt and silica, and passing the mixture through a colloid mill in the manner set forth hereinabove.

The total detergent composition herein is prepared by dry-mixing the detergent component, the clay component and the anti-static component. The composition is added to an aqueous laundering bath at a concentration of 0.15% by weight and fabrics laundered therein are cleansed and provided with an anti-static and softened finish In the foregoing composition the alkyl ether sulfate mixture is replaced by an equivalent amount of Compositions II, III and IV of Table I, respectively, and equivalent results are secured.

In the foregoing composition the $C_{12}$ alkylbenzene sulfonate and alkylether sulfate anionic surfactant mixture is replaced by a total equivalent amount of sodium linear $C_{10}$-$C_{18}$ alkylbenzene sulfonate; triethanolamine $C_{10}$-$C_{18}$ alkylbenzene sulfonate; sodium tallowalkyl sulfate; sodium coconutalkyl glyceryl ether sulfonate; the sodium salt of a sulfated condensation product of a tallow alcohol with from about 3 to about 10 moles of ethylene oxide; 3-(N,N-dimethyl-N-coconutalkylammonio)-2-hydroxypropane-1-sulfonate; 3-(N,N-dimethyl-N-coconutalkylammonio)-propane-1-sulfonate; 6-(N-dodecylbenzyl-N,N-dimethylammonio)hexanoate; dodecyl dimethyl amine oxide; coconutalkyl dimethyl amine oxide; and the water-soluble sodium and potassium salts of higher fatty acids containing 8 to 24 carbon atoms, respectively, and equivalent results are secured.

In the foregoing composition the di-tallowalkyl dimethyl ammonium chloride is replaced by an equivalent amount of distearyl dimethyl ammonium chloride and equivalent results are secured.

What is claimed is:

1. A fabric softener and anti-static composition especially adapted for use in combination with anionic, zwitterionic and ampholytic surfactants, comprising:

a. from about 10% to about 99% by weight of a softening component comprising a smectite clay having an ultimate particle diameter of from about 150 anstroms to about 4500 angstroms; and b. from about 1% to about 99% by weight of an anti-static component comprising a mixture of a quaternary compound and an electrically conductive salt wherein the electrically conductive salt is uniformly dispersed in the quaternary compound wherein:

i. the quaternary compound has the formula

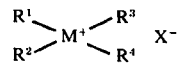

wherein M is nitrogen or phosphorus, X is any anion, $R^1$ is a hydrocarbyl moiety, $R^2$ is hydrogen or a hydrocarbyl moiety, the total carbon content of $R^1 + R^2$ being at least 22 carbon atoms, and $R^3$ and $R^4$ are each hydrogen or hydrocarbyl moieties; and ii. the electrically conductive salt is selected from the group consisting of aluminum salts and lithium salts, at a weight ratio of quaternary compound:salt in said anti-static component in the range of 1000:1 to 1:5.

2. A composition according to claim 1 wherein the weight ratio of softening component:anti-static component is in the range of from 1:2 to 25:1.

3. A composition according to claim 1 wherein the clay is selected from the group consisting of montmorillonite, volschonskoite, nontronite, beidellite, hectorite, saponite, sauconite and vermiculite.

4. A composition according to claim 1 wherein the clay is Wyoming bentonite having an average particle diameter in the range of from 200 angstroms to about 500 angstroms.

5. A composition according to claim 1 wherein the quaternary compound is an ammonium compound.

6. A composition according to claim 5 wherein the ammonium compound is a di-long chain compound wherein $R^1$ and $R^2$ are each selected from the group consisting of $C_{11}$ - $C_{18}$ alkyl moieties, and mixtures thereof, and wherein $R^3$ and $R^4$ are each selected from the group consisting of $C_1$ - $C_3$ alkyl moieties, and mixtures thereof.

7. A composition according to claim 6 wherein the ammonium compound is di-tallowalkyl dimethyl ammonium chloride.

8. A composition according to claim 1 wherein the conductive salt is an aluminum salt.

9. A composition according to claim 1 wherein the conductive salt is a member selected from the group consisting of $Al_2(SO_4)_3$, $Al_2(SO_4)_3 \cdot 18\ H_2O$ and $LiCl \cdot 1\ H_2O$.

10. A composition according to claim 1 wherein the weight ratio of quaternary compound:conductive salt is in the range of about 20:1 to 1:2.

11. A composition according to claim 1 wherein the anti-static component comprises:

i. from about 5% to about 50% by weight of $Al_2(SO_4)_3 \cdot 18\ H_2O$; and ii. from about 50% to about 95% by weight of di-tallowalkyl dimethyl ammonium chloride.

12. A detergent composition adapted to imparting an anti-static effect to fabrics in an aqueous laundering medium, comprising:

a. from about 1% to about 99.9% by weight of a water-soluble detergent component selected from the group consisting of anionic, nonionic, amphoteric and zwitterionic surfactants; and b. from about 0.1% to about 20% by weight of an anti-static component comprising a mixture of a quaternary compound and an electrically conductive salt wherein the electrically conductive salt is uniformly dispersed in the quaternary compound wherein:

i. the quaternary compound has the formula

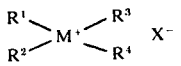

wherein M is nitrogen or phosphorus, X is any anion, $R^1$ is a hydrocarbyl moiety, $R^2$ is hydrogen or a hydrocarbyl moiety, the total carbon content of $R^1 + R^2$ being at least 22 carbon atoms, and $R^3$ and $R^4$ are each hydrogen or hydrocarbyl moieties; and ii. the electrically conductive salt is selected from the group consisting of aluminum salts and lithium salts, at a weight ratio of quaternary compound:salt in said anti-static component in the range of 1000:1 to 1:5.

13. A composition according to claim 12 wherein the detergent component is a water-soluble soap.

14. A composition according to claim 12 wherein the detergent component is a water-soluble salt of an organic sulfuric reaction product having in its molecular structure an alkyl group containing from about 8 to about 22 carbon atoms and a sulfonic acid or sulfuric acid ester group.

15. A composition according to claim 12 which contains, as an additional component, from about 5% to about 80% by weight of a detergency builder.

16. A detergent composition adapted to imparting a softening and anti-static effect to fabrics in an aqueous laundering medium, comprising:

a. from about 5% to about 50% by weight of a water-soluble detergent component selected from the group consisting of anionic, nonionic, amphoteric and zwitterionic surfactants;

b. from about 1% to about 40% by weight of a softening component comprising a smectite clay having an ultimate particle diameter of from about 150 angstroms to about 4500 angstroms; and c. from about 0.1% to about 20% by weight of an anti-static component comprising a mixture of a quaternary compound and an electrically conductive salt wherein the electrically conductive salt is uniformly dispersed in the quaternary compound wherein:

i. the quaternary compound has the formula

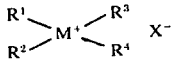

wherein M is nitrogen or phosphorus, X is any anion, $R^1$ is a hydrocarbyl moiety, $R^2$ is hydrogen or a hydrocarbyl moiety, the total carbon content of $R^1 + R^2$ being at least 22 carbon atoms, and $R^3$ and $R^4$ are each hydrogen or hydrocarbyl moieties; and ii. the electrically conductive salt is selected from the group consisting of aluminum salts and lithium salts, at a weight ratio of quaternary compound:salt in said anti-static component in the range of 1000:1 to 1:5.

17. A composition according to claim 16 wherein the detergent component is a water-soluble soap.

18. A composition according to claim 16 wherein the detergent component is a water-soluble salt of an organic sulfuric reaction product having in its molecular structure an alkyl group containing from about 8 to about 22 carbon atoms and a sulfonic acid or sulfuric acid ester group.

19. A composition according to claim 16 wherein the detergent component is a member selected from the group consisting of sodium linear $C_{10}$-$C_{18}$ alkylbenzene sulfonate; triethanolamine $C_{10}$-$C_{18}$ alkylbenzene sulfonate; sodium tallow alkyl sulfate; sodium coconut alkylglycerylether sulfonate; the sodium salt of a sulfated condensation product of a tallow alcohol with from about 3 to about 10 moles of ethylene oxide; 3-(N,N-dimethyl-N-coconutalkylammonio)-2-hydroxypropane-1-sulfonate; 3-(N,N-dimethyl-N-coconutalkylammonio)-propane-1-sulfonate; 6-(N-dodecylbenzyl-N,N-dimethylammonio)hexanoate; dodecyl dimethyl amine oxide; coconutalkyl dimethyl amine oxide; and the water-soluble sodium and potassium salts of higher fatty acids containing 8 to 24 carbon atoms.

20. A composition according to claim 16 wherein the detergent component comprises a mixture of water-soluble $C_{10}$-$C_{18}$ alkyl ether sulfates.

21. A composition according to claim 16 wherein the weight ratio of softening component:anti-static component is in the range of from 1:2 to 10:1.

22. A composition according to claim 16 wherein the clay is selected from the group consisting of montmorillonite, volschonskoite, nontronite, beidellite, hectorite, saponite, sauconite and vermiculite.

23. A composition according to claim 16 wherein the quaternary compound is an ammonium compound.

24. A composition according to claim 16 wherein the ammonium compound is a di-long chain compound wherein $R^1$ and $R^2$ are each selected from the group consisting of $C_{11}$ - $C_{18}$ alkyl moieties, and mixtures thereof, and wherein $R^3$ and $R^4$ are each selected from the group consisting of $C_1$ - $C_3$ alkyl moieties, and mixtures thereof.

25. A composition according to claim 16 wherein the ammonium compound is di-tallowalkyl dimethyl ammonium chloride.

26. A composition according to claim 16 wherein the conductive salt is an aluminum salt.

27. A composition according to claim 16 wherein the conductive salt is a member selected from the group consisting of $Al_2(SO_4)_3$, $Al_2(SO_4)_3 \cdot 18\ H_2O$ and $LiCl \cdot 1\ H_2O$.

28. A composition according to claim 16 wherein the weight ratio of quaternary compound:conductive salt is in the range of from about 20:1 to about 1:2.

29. A composition according to claim 28 wherein the ratio of softening component:anti-static component is in the range of from 1:2 to 10:1.

30. A composition according to claim 16 which contains, as an additional component, from about 5% to about 80% by weight of a detergency builder.

31. A composition according to claim 16, comprising:

a. from about 4% to about 10% by weight of a water-soluble alkyl ether sulfate detergent component;

b. from about 5% to about 20% by weight of a Wyoming bentonite clay softening component having an ultimate particle diameter of from about 200 angstroms to about 500 angstroms;

c. from about 5% to about 15% by the weight of an anti-static component comprising:

i. from about 5% to about 50% by weight of $Al_2(SO_4)_3 \cdot 18\ H_2O$; and ii. from about 50% to about 80% by weight of di-tallowalkyl dimethyl ammonium chloride; and d. from about 15% to about 40% by weight of a detergency builder.

32. A composition according to claim 31 wherein the detergency builder is an organic builder.

33. A composition according to claim 31 wherein the detergency builder is an inorganic builder.

34. A composition according to claim 31 wherein the builder is a seeded builder.

35. A composition according to claim 31 wherein the anti-static component is sorbed on a carrier.

36. A composition according to claim 35 wherein the carrier is silica.

37. A composition according to claim 1 wherein the anti-static component is in the form of finely divided particles.

38. A composition according to claim 12 wherein the anti-static component is in the form of finely divided particles.

39. A composition according to claim 16 wherein the anti-static component is in the form of finely divided particles.

* * * * *